US007159726B1

(12) United States Patent
Stenton

(10) Patent No.: US 7,159,726 B1
(45) Date of Patent: Jan. 9, 2007

(54) MOBILE MERCHANDISING UNIT

(76) Inventor: Paul A. Stenton, 107 Wenlock Road, South Shields, Tyne & Wear, London (GB) NE349BD ( * ) Notice: Subject to any disclaimer, the term of this patent is extended or adjusted under 35 U.S.C. 154(b) by 454 days.

(21) Appl. No.: 10/726,729

(22) Filed: Dec. 4, 2003

(51) Int. Cl.
*A47F 7/00* (2006.01)

(52) U.S. Cl. ..... 211/49.1

(58) Field of Classification Search ..... 211/49.1, 211/85.26, 133.1; 280/47.35; 312/35, 45, 312/60, 72, 211, 140.3, 249.8, 249.13
See application file for complete search history.

(56) References Cited

U.S. PATENT DOCUMENTS 3,300,088 A * 1/1967 Steier et al. ..... 221/97
3,776,419 A * 12/1973 Zinkgraf et al. ..... 221/197
3,948,417 A * 4/1976 McCain ..... 221/135
4,395,955 A * 8/1983 Pfeifer ..... 108/61
5,509,672 A * 4/1996 Offerson ..... 280/47.35
5,634,649 A * 6/1997 Breining et al. ..... 280/47.35
6,935,644 B1 * 8/2005 Oranday ..... 280/47.34
6,955,366 B1 * 10/2005 Tokarev ..... 280/47.34

* cited by examiner

*Primary Examiner*—Sarah Purol

(57) ABSTRACT

A mobile merchandising unit for storing and displaying merchandise particularly in a retail store. The mobile merchandising unit includes a cart assembly including a cabinet being mounted upon a wheel assembly and having bottom, side, top, and back walls, and also having a tray section being disposed upon the cabinet; and also includes a chute assembly being mounted upon the cart assembly and including a plurality of chutes being disposed side by side and being adapted to receive merchandise.

3 Claims, 3 Drawing Sheets

MOBILE MERCHANDISING UNIT

BACKGROUND OF THE INVENTION

1. Field of the Invention

The present invention relates to mobile kiosks and more particularly pertains to a new mobile merchandising unit for storing and displaying merchandise particularly in a retail store.

2. Description of the Prior Art

The use of mobile kiosks is known in the prior art. More specifically, mobile kiosks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,443,168; U.S. Pat. No. 4,744,474; U.S. Pat. No. 3,948,417; U.S. Pat. No. 2,525,208; U.S. Pat. No. 638,569; and U.S. Pat. No. 669, 075.

While these devices fulfill their respective, particular objectives and requirements, the aforementioned patents do not disclose a new mobile merchandising unit. The prior art describes inventions having a cart assembly with shelves and storage compartments for selected items.

SUMMARY OF THE INVENTION

The general purpose of the present invention, which will be described subsequently in greater detail, is to provide a new mobile merchandising unit which has many of the advantages of the mobile kiosks mentioned heretofore and many novel features that result in a new mobile merchandising unit which is not anticipated, rendered obvious, suggested, or even implied by any of the prior art mobile kiosks, either alone or in any combination thereof. The present invention includes a cart assembly including a cabinet being mounted upon a wheel assembly and having bottom, side, top, and back walls, and also having a tray section being disposed upon the cabinet; and also includes a chute assembly being mounted upon the cart assembly and including a plurality of chutes being disposed side by side and being adapted to receive merchandise. None of the prior art includes a chute assembly being mounted upon a cart assembly.

There has thus been outlined, rather broadly, the more important features of the mobile merchandising unit in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new mobile merchandising unit which has many of the advantages of the mobile kiosks mentioned heretofore and many novel features that result in a new mobile merchandising unit which is not anticipated, rendered obvious, suggested, or even implied by any of the prior art mobile kiosks, either alone or in any combination thereof.

Still another object of the present invention is to provide a new mobile merchandising unit for storing and displaying merchandise particularly in a retail store.

Still yet another object of the present invention is to provide a new mobile merchandising unit that is easy and convenient to use.

Even still another object of the present invention is to provide a new mobile merchandising unit that optimizes exposure of merchandise that is not easily displayed for sale.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
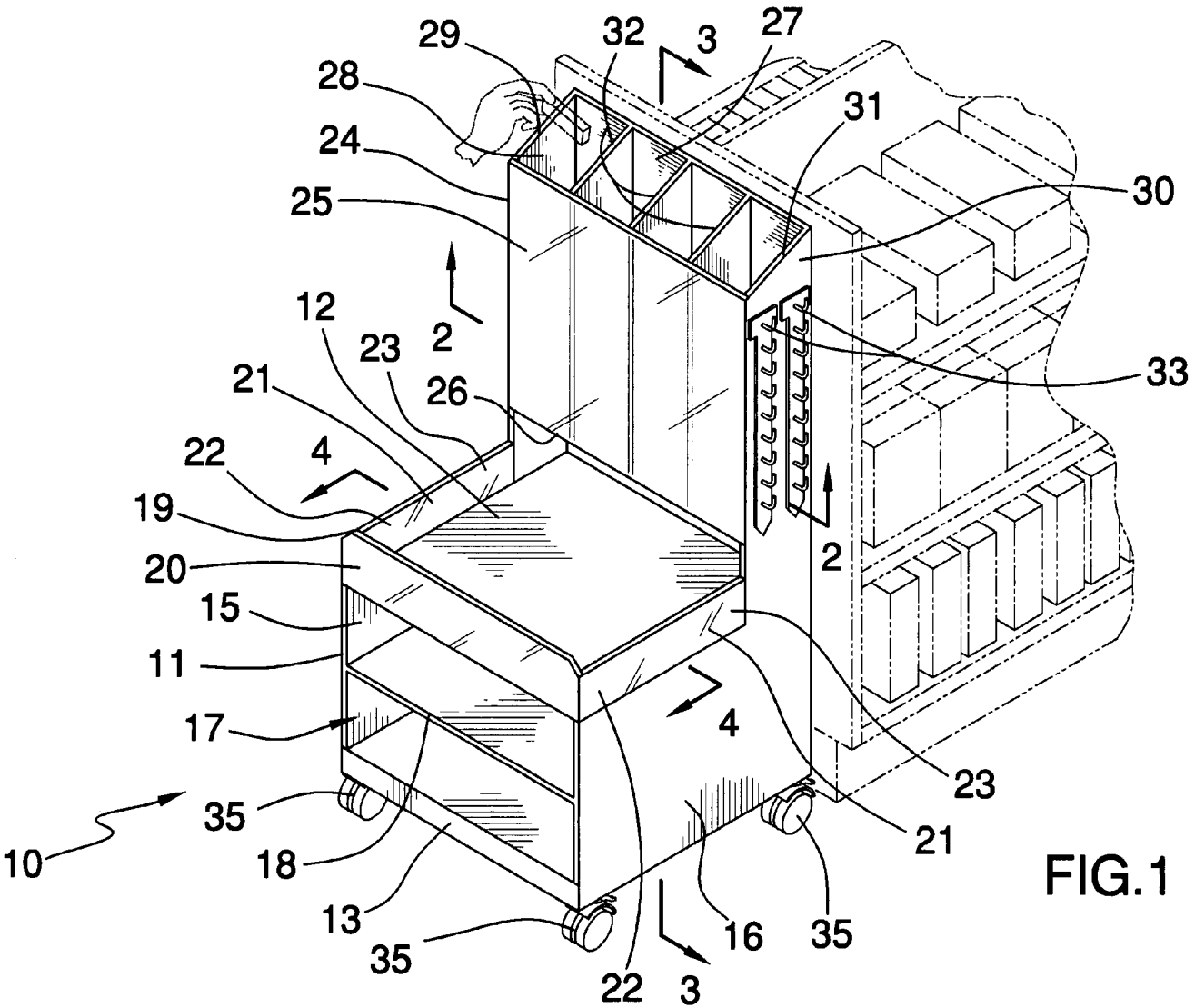
FIG. 1 is a perspective view of a new mobile merchandising unit according to the present invention and shown in use.
Figure 2:
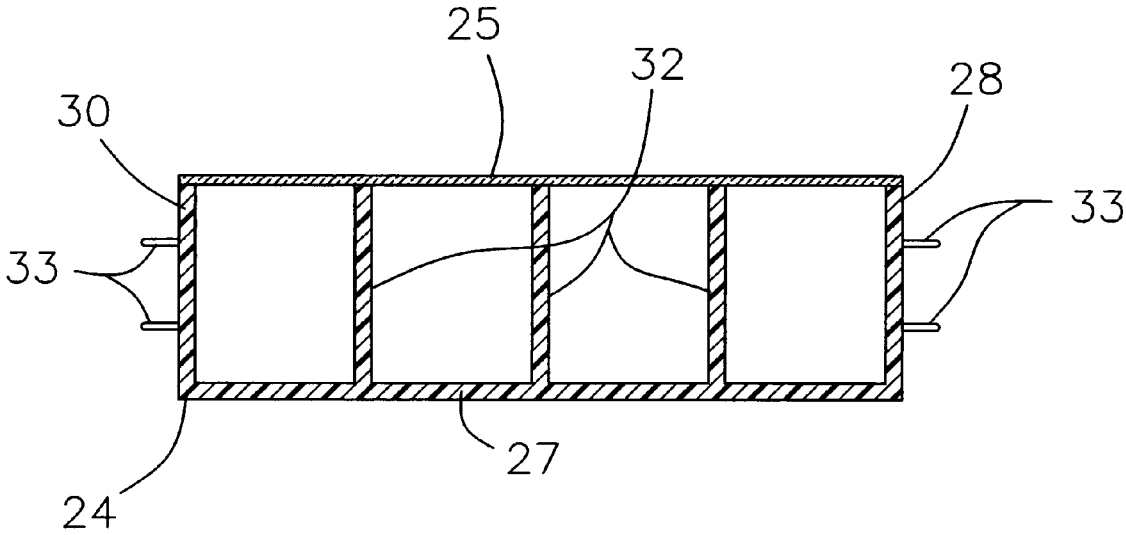
FIG. 2 is a lateral cross-sectional view of the chutes of the present invention.
Figure 4:
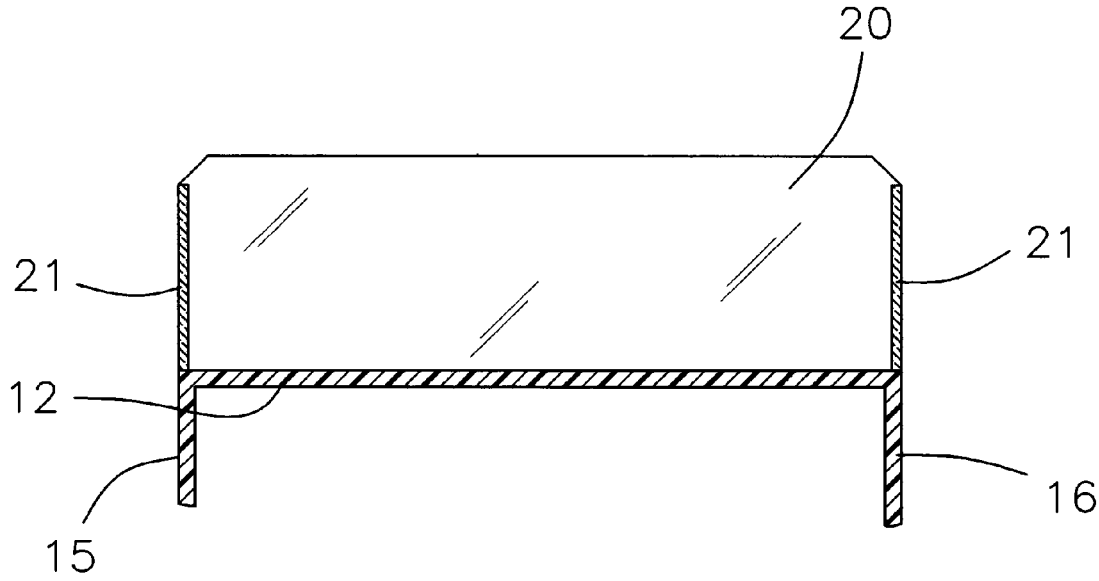
FIG. 4 is a cross-sectional view of the tray section of the present invention
Figure 3:
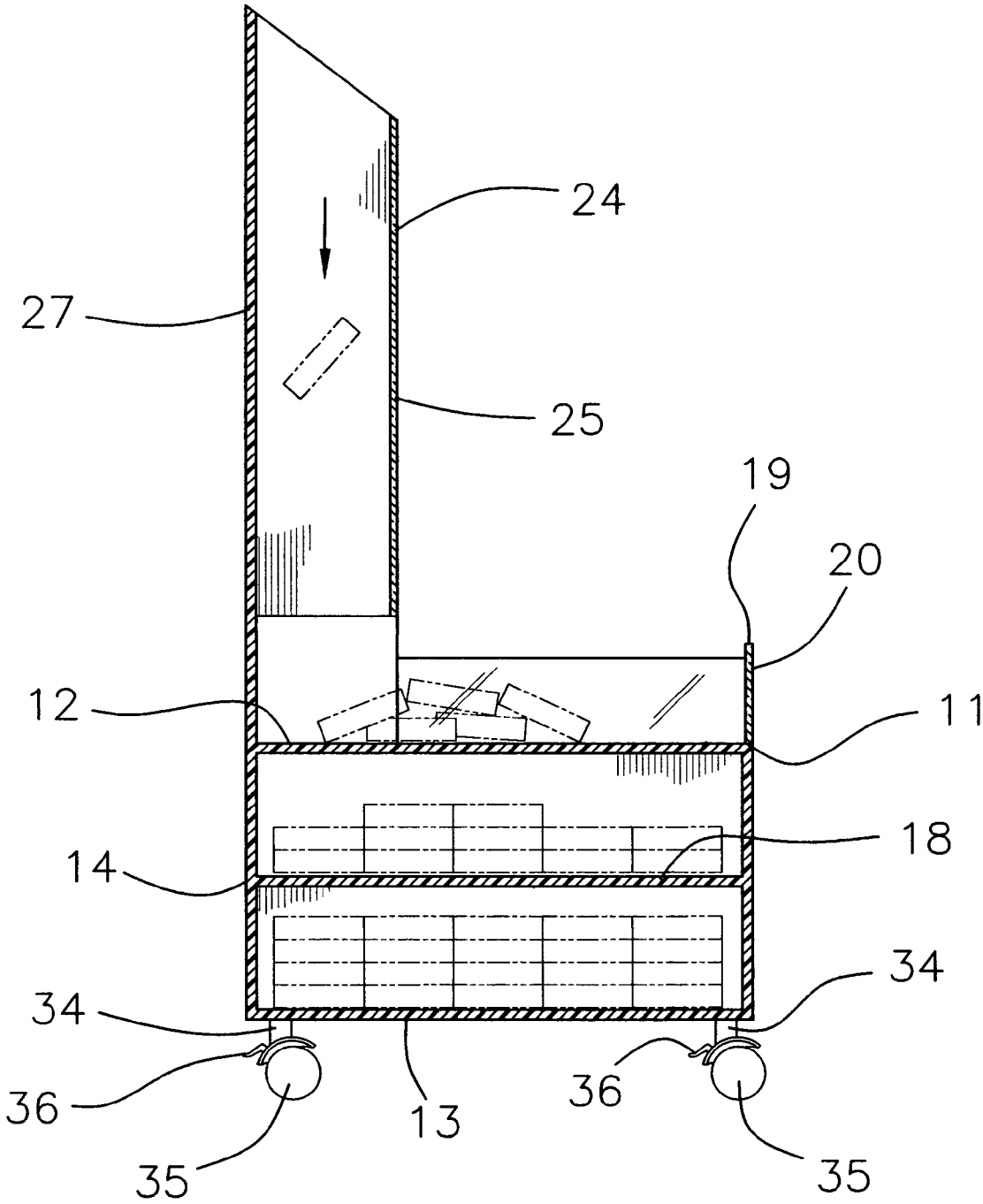
FIG. 3 is a side cross-sectional view of the present invention.

With reference now to the drawings, and in particular to FIGS. 1 through 4 thereof, a new mobile merchandising unit embodying the principles and concepts of the present invention and generally designated by the reference numeral 10 will be described.

As best illustrated in FIGS. 1 through 4, the mobile merchandising unit 10 generally comprises a cart assembly including a cabinet 11 being mounted upon a wheel assembly and having bottom, side, top, and back walls 12–16, and also having a tray section 19 being conventionally disposed upon the cabinet 11. The cabinet 11 has an open front 17 through which merchandise can be stored in the cabinet 11. The cart assembly further includes a shelf 18 being conventionally disposed intermediate of the top and bottom walls 12,13 in the cabinet 11 for storing the merchandise thereupon. The wheel assembly includes wheel support members 34 being conventionally disposed in an underside of the bottom wall 13 of the cabinet 11, and also includes wheel members 35 being rotatably and conventionally mounted to the wheel support members 34, and further includes conventional brake members 36 being engagable to the wheel members 35 for locking the wheel members 35. The tray section 19 includes the top wall 12 of the cabinet 11 and also includes front, and side panels 20–23 being conventionally attached along front and side perimeters of and extending upwardly from the top wall 12 of the cabinet 11. Each of the side panels 21 has a transparent forward portion 22 and a rearward portion 23.

A chute assembly is conventionally mounted upon the cart assembly and includes a plurality of chutes 24 being disposed side by side and being adapted to receive merchandise. The chute assembly includes a transparent front panel 25, a back wall 27, and side walls 28,30. The front panel 25 has a bottom edge 26 which is suspended above the top wall 12 of the cabinet 11 to allow merchandise to pass from the chutes 24 onto the tray section 19. The back wall 27 is a continuation of the back wall 14 of the cabinet 11 and the side walls 28,30 are conventionally attached upon side and back perimeters of the top wall 12 of the cabinet 11. The back wall 27 extends higher than the front panel 25 with each of the side walls 28,30 having a top edge 29,31 which is slanted downwardly from the back wall 27 to the front panel 25. The chute assembly further includes a plurality of partitions 32 being spaced apart and being conventionally disposed between the front panel 25 and the back wall 27 thus forming the plurality of chutes 24. The chute assembly also includes a plurality of hooks 33 being conventionally attached to exteriors of the side walls 28,30 near the top edges 29,31 thereof for supporting selected items.

In use, the user moves the cart assembly to a location in the retail store where the consumers can select the merchandise displayed upon the tray section 19. The user locks the wheel members 35 using the brake members 36 so that the cart assembly cannot be moved about. As the consumers buy the merchandise from the tray section 19, the user can restock the merchandise by putting the merchandise through the open top ends of the chutes 24; whereupon the merchandise passes through the chutes 24 onto the tray section 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the mobile merchandising unit. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mobile merchandising unit comprising:

a cart assembly including a cabinet being mounted upon a wheel assembly and having bottom, side, top, and back walls, and also having a tray section disposed upon said cabinet; and a chute assembly being mounted upon said cart assembly and including a plurality of chutes being disposed side by side and being adapted to receive merchandise, said chute assembly including a transparent front panel, a back wall, and side walls, said front panel having a bottom edge which is suspended above said top wall of said cabinet to allow merchandise to pass from said chutes onto said tray section, said back wall being a continuation of said back wall of said cabinet and said side walls being attached upon side and back perimeters of said top wall of said cabinet, said back wall extending higher than said front panel with each of said side walls having a top edge which is slanted downwardly from said back wall to said front panel to identify and distinguish the chutes and to facilitate placement of merchandise in the chutes.

2. The mobile merchandising unit as described in claim 1, wherein said chute assembly further includes a plurality of partitions being spaced apart and being disposed between said front panel and said back wall thus forming said plurality of chutes.

3. The mobile merchandising unit as described in claim 1, wherein said chute assembly also includes a plurality of hooks being attached to exteriors of said side walls near said top edges thereof for supporting selected items.

* * * * *